US007402087B2

(12) United States Patent
Wang

(10) Patent No.: US 7,402,087 B2
(45) Date of Patent: Jul. 22, 2008

(54) ELECTRIC CONNECTOR

(75) Inventor: Hong-Fang Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,586

(22) Filed: Aug. 1, 2007

(65) Prior Publication Data

US 2008/0032557 A1 Feb. 7, 2008

(51) Int. Cl.
*H01R 13/40* (2006.01)

(52) U.S. Cl. ..... 439/752.5; 439/382; 439/748; 439/851; 439/595

(58) Field of Classification Search ..... 439/382, 439/752.5, 748, 595, 851
See application file for complete search history.

(56) References Cited

U.S. PATENT DOCUMENTS 4,580,341 A 4/1986 Chapelot
4,708,416 A 11/1987 Awano
5,035,658 A 7/1991 Berg
5,664,969 A 9/1997 Peterson
5,697,813 A * 12/1997 Ikeda ..... 439/595
6,120,333 A 9/2000 Ko
6,302,748 B1 * 10/2001 Xu et al. ..... 439/752.5
6,811,450 B1 11/2004 Data
7,112,105 B2 * 9/2006 Wu ..... 439/752.5
2005/0266739 A1 * 12/2005 Wu ..... 439/752.5

* cited by examiner

*Primary Examiner*—Tho D Ta
(74) *Attorney, Agent, or Firm*—Wei Te Chung

(57) ABSTRACT

An electric connector (100) includes an insulative housing (2) having front and rear walls (21, 22), a terminal passageway (23) defined between said front and rear walls and having top and bottom walls (25, 24), and a conductive terminal (3) assembled to the insulative housing to be retained in the terminal passageway and having a base wall (31) and a pair of spring arms (32) extending from the base wall and adapted for mating with said pin terminal. The pair of spring arms face to each other and define between the pair of spring arms a space (32*a*) adapted for receiving the pin terminal. Each spring arm has a free end. A protrusion (26) is integrally formed with the top wall of the terminal passageway and extends into the terminal passageway, and is located between said free ends of the pair of spring arms to prevent unnecessary shake of the free ends of the spring arms.

16 Claims, 5 Drawing Sheets

ELECTRIC CONNECTOR

BACKGROUND OF THE INVENTION

1. Field of the Invention

This invention generally relates to an electric connector, and more particularly to an electric connector which can prevent a contact therein from waving or deflecting.

2. Description of the Prior Art

In U.S. Pat. No. 6,120,333, an electrical connector for connecting conductors of a conductive cable to a terminal of a complementary connector comprises a dielectric housing defining an array of terminal passageways therein. A dam upward extends from each terminal passageway. A wedge rearwardly extends from the dam thereby defining a retaining gap between an inner surface of the passageway and the wedge. Terminals are assembled in the terminal passageways and each has a mating portion adapted to mate with a corresponding terminal of the complementary connector. A tongue extends from the mating portion for being securely retained within the gap. A cavity is defined adjacent to the retaining gap for retaining an anchoring foot of the terminal.

U.S. Pat. No. 5,664,969 discloses an electrical connector adapted for connecting a conductor of an electrical cable to a terminal of a mating connector. A dielectric housing has at least one elongated terminal-receiving cavity defining a longitudinal axis. A terminal is received in the cavity and has a mating portion adapted to mate with the terminal of the mating connector, a conductor-terminating portion, and an intermediate portion joining the mating and conductor-terminating portions. The intermediate portion includes a base and a pair of elongated resilient side walls extending from the base. Each side wall has an upper free end portion. A pair of elongated slots are provided within a wall of the cavity receiving the upper free end portions of the side walls of the terminal to prevent movement of the terminal laterally or angularly relative to the longitudinal axis.

BRIEF SUMMARY OF THE INVENTION

It is an object of the present invention to provide an electric connector which can prevent a contact therein from waving or deflecting.

In order to attain the object above, an electric connector for connecting a conductor of a conductive wire to a pin terminal of a complementary connector according to the present invention comprises an insulative housing having front and rear walls, a terminal passageway defined between said front and rear walls and having top and bottom walls, and a conductive terminal assembled to the insulative housing to be retained in the terminal passageway and having a base wall and a pair of spring arms extending from the base wall and adapted for mating with said pin terminal. The pair of spring arms face to each other and define between the pair of spring arms a space adapted for receiving the pin terminal. Each spring arm has a free end. A protrusion is integrally formed with the top wall of the terminal passageway and extends into the terminal passageway, and is located between said free ends of the pair of spring arms to prevent unnecessary shake of the free ends of the spring arms.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
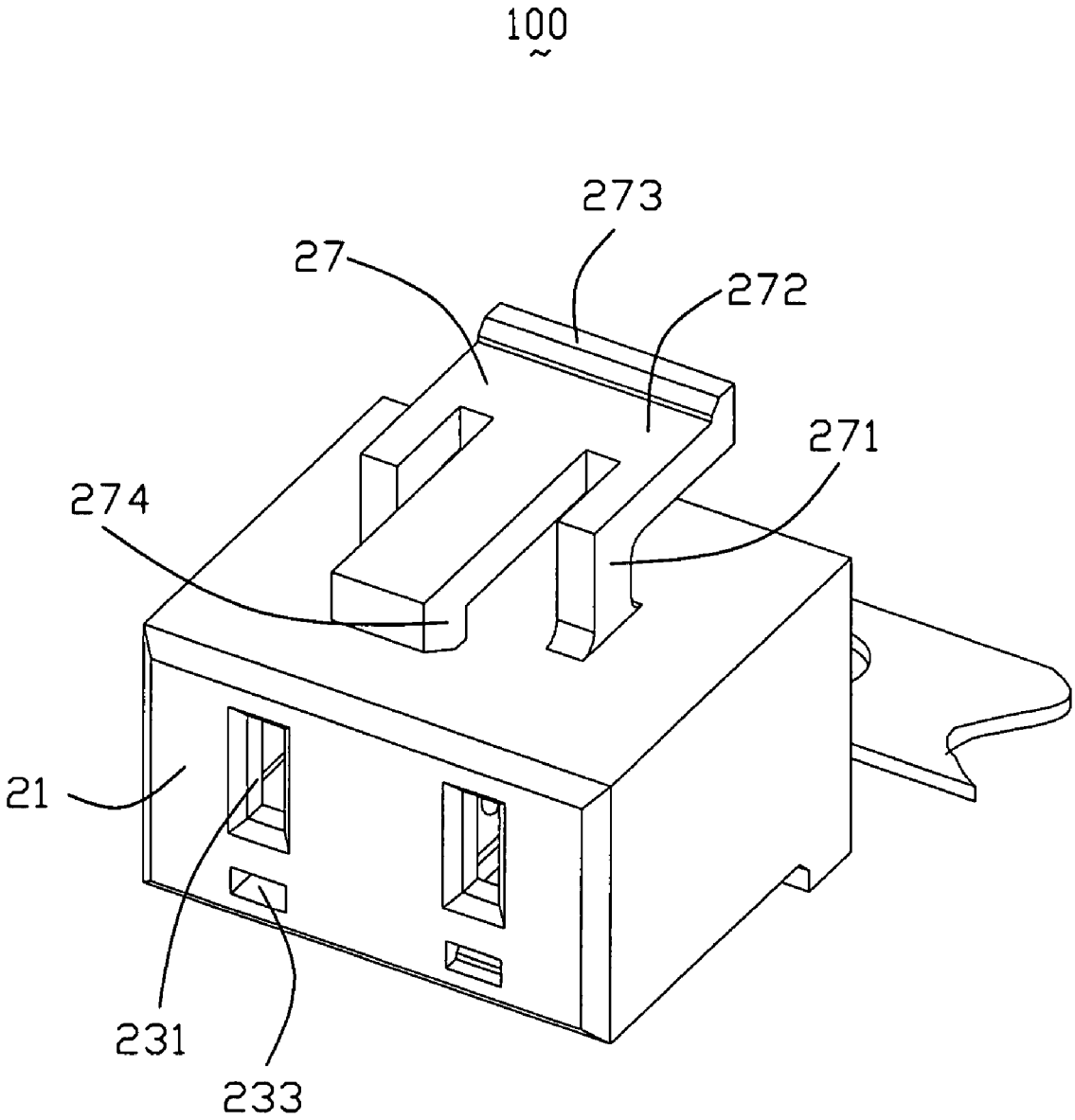
FIG. 1 is an assembled view of an electric connector in accordance with the present invention.

Reference will now be made in detail to the preferred embodiment of the present invention.

As shown in FIGS. 1-5, an electric connector 100 according to the present invention comprises an insulative housing 2 and a pair of conductive terminals 3 (only one is shown for simplicity) held in the housing 2. The housing 2 has a front wall 21, a rear wall 22 opposite to the front wall 21, bottom and top walls 24 and 25 connecting the front wall 21 and the rear wall 22 and facing to each other. A pair of terminal passageways 23 each for receiving a corresponding terminal 3 are defined between the front wall 21 and the rear wall 22. A front opening 231 from which a pin terminal (not shown) of a complement connector (not shown) is inserted into the housing 2 to electrically and physically connect corresponding terminal 3 and a rear opening 232 from which corresponding terminal 3 is inserted into the housing 2 are defined at opposite ends of each passageway 23.

Figure 3:
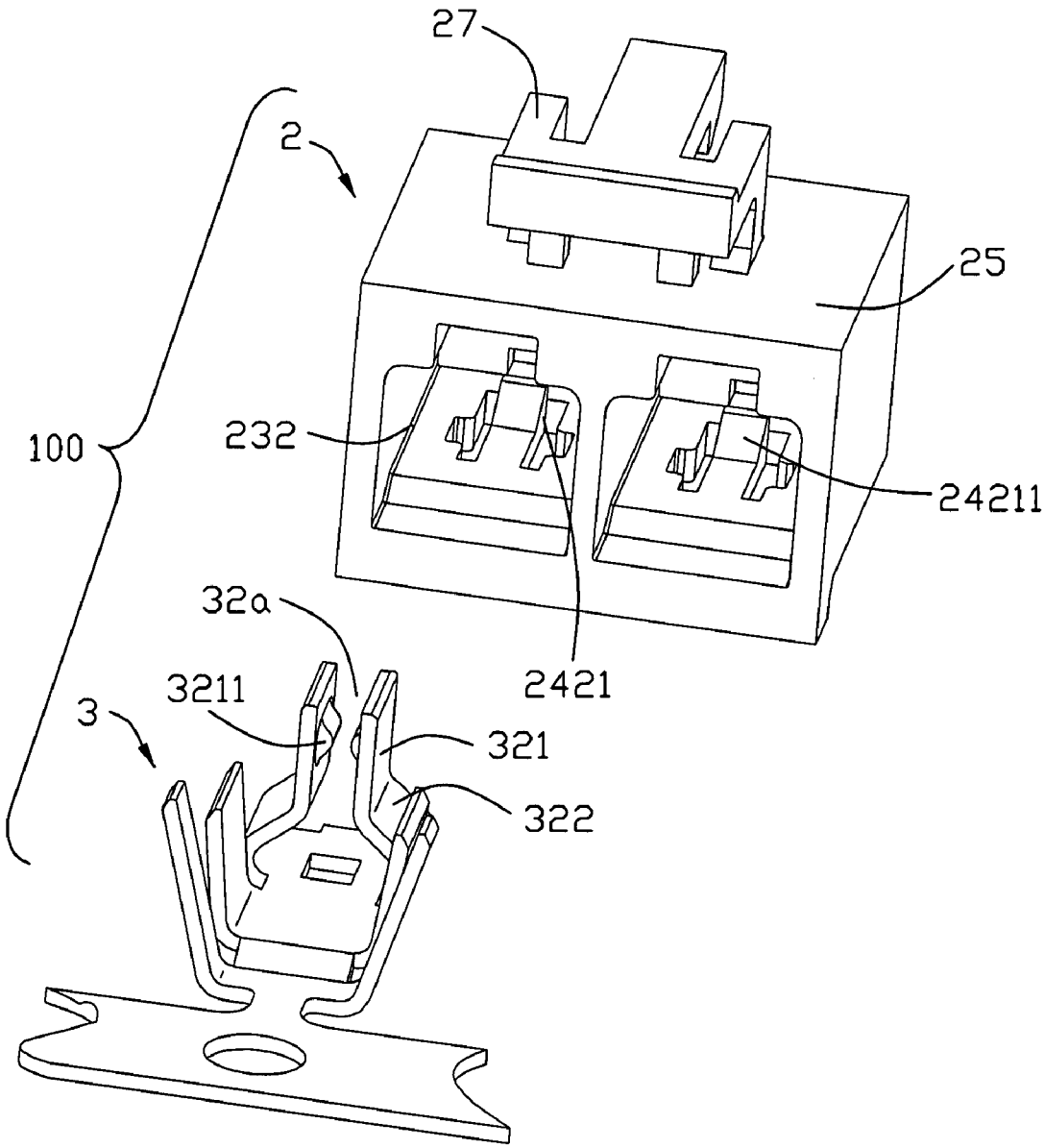
FIG. 3 is an exploded, perspective view of the electric connector shown in FIG. 1.
Figure 4:
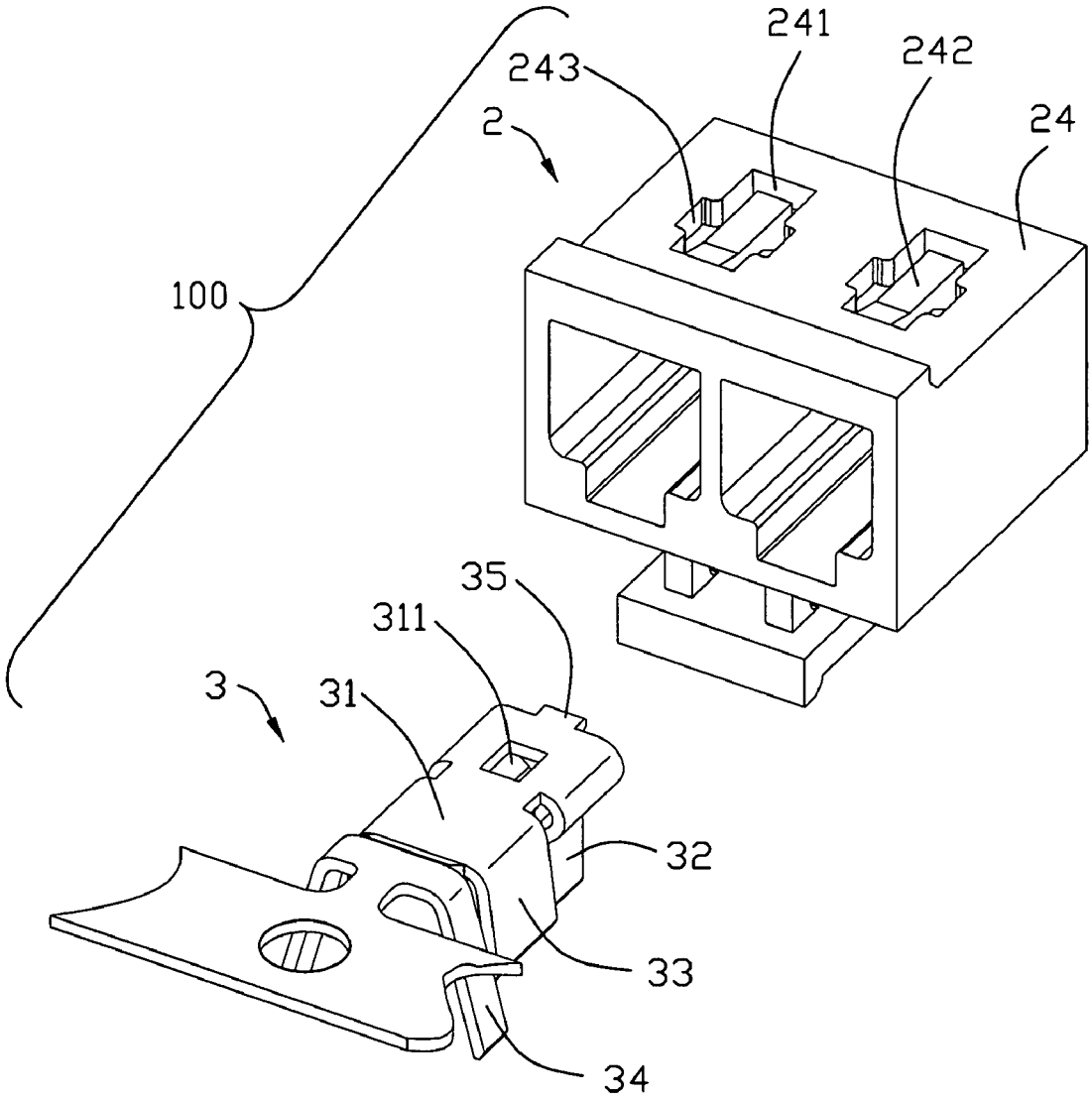
FIG. 4 is a view similar to FIG. 3, but viewed from another aspect.

Referring to FIGS. 3-4, a pair of rectangular openings 241 are defined through the bottom wall 24 of the housing 2 to communicate with the pair of terminal passageways 23. In each opening 231, an elastic terminal retaining finger 242 formed integrally with the bottom wall 24 is of wedge-shape and protrudes into the terminal passageway 23. A wedge-shape protrusion 2421 is formed at the free end of each elastic terminal retaining finger 242. An inclined surface 24211 is formed with each protrusion 2421 and faces to the terminal passageways 23 to lead corresponding terminal 3 to pass through the protrusion 2421 when the conductive terminal 3 is inserted into the housing 2. The terminal 3 has a base wall 31 which forms a retaining hole 311 for receiving the protrusion 2421 of the terminal retaining finger 242 in order to hold the terminal 3 at a proper position of the housing 2. A pair of secondary openings 243 recess outwardly and oppositely from the periphery of each rectangular opening 241 and communicated with the rectangular opening 241 so that a hook (not shown) can be inserted from the secondary openings 243 into the terminal passageway 23 to catch and pull the top surface (not labeled) of the terminal retaining finger 242 out of the retaining hole 311 for releasing the terminal 3 from the housing 2.

Figure 2:
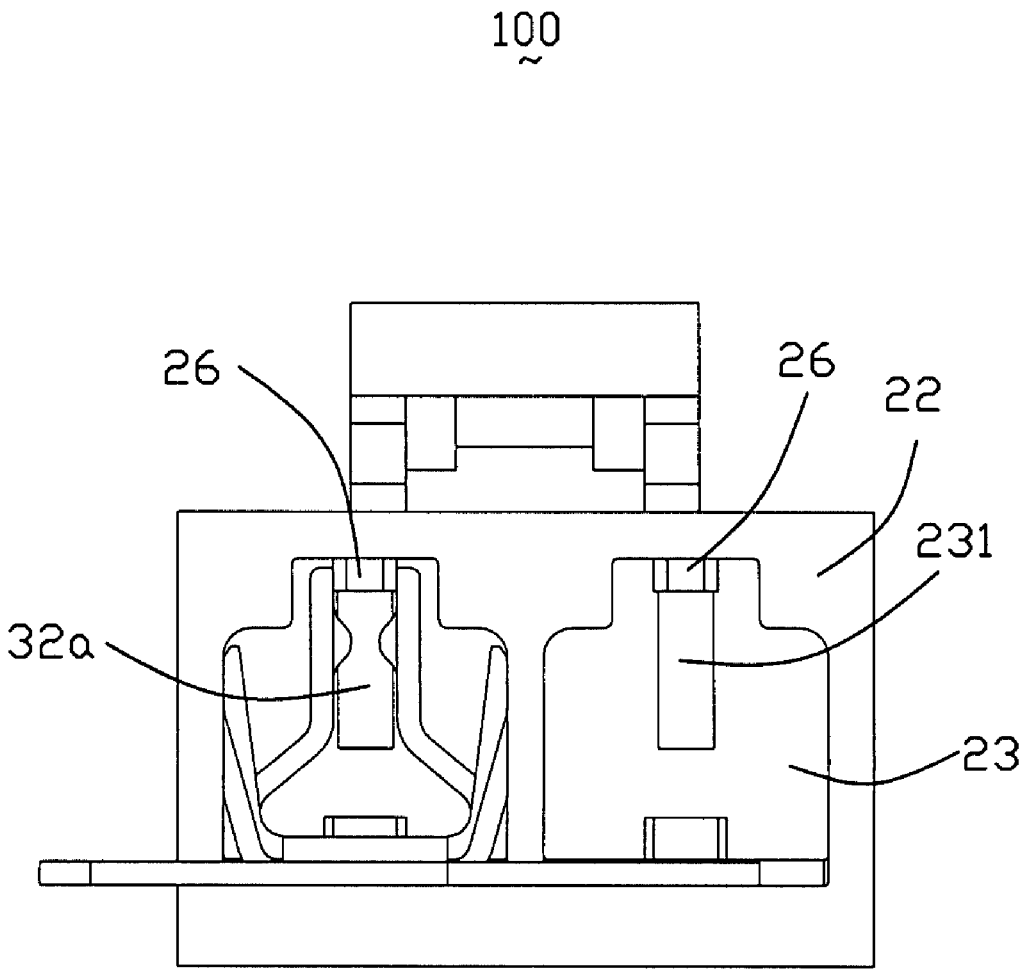
FIG. 2 is a rear elevation view thereof.
Figure 5:
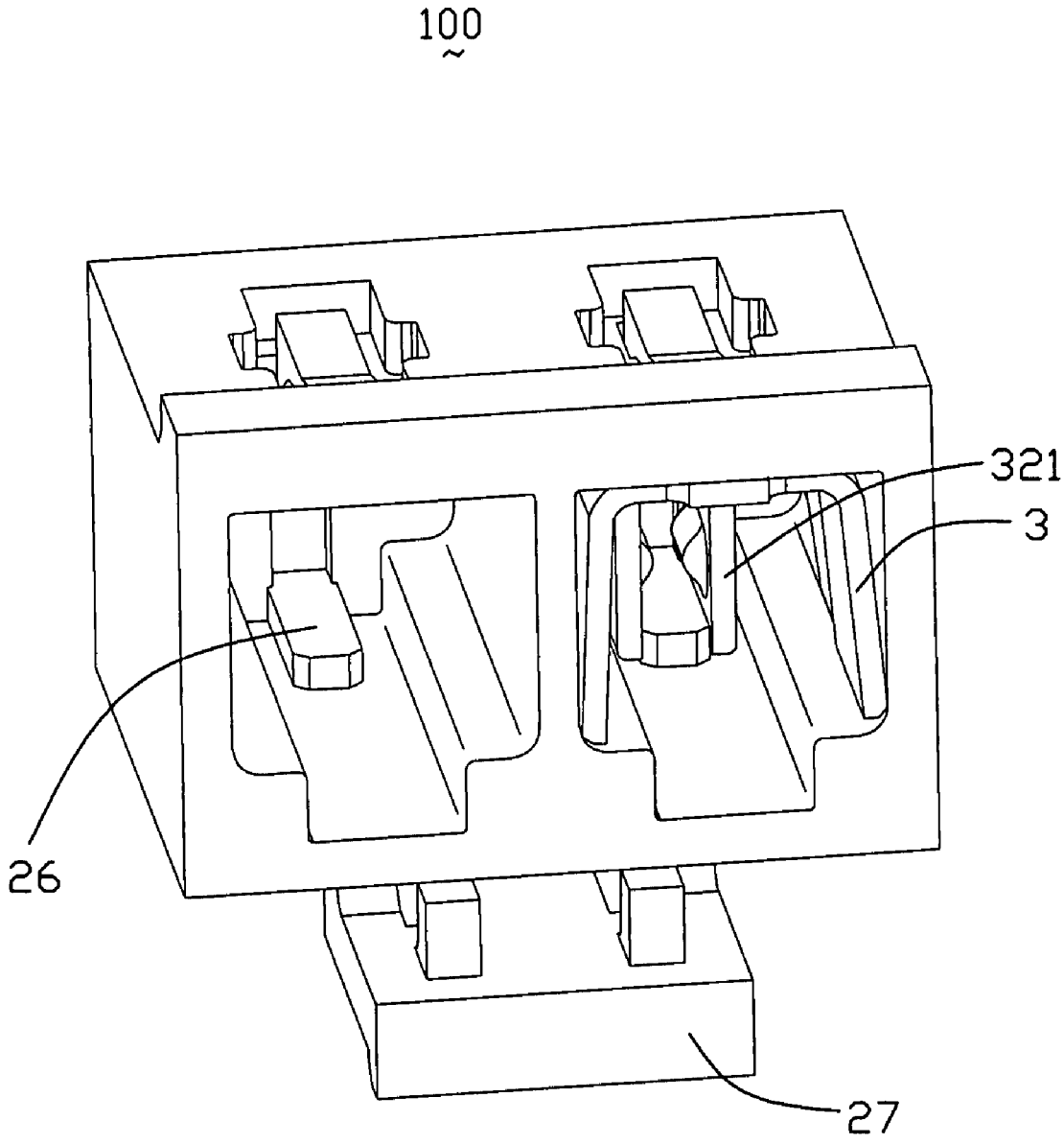
FIG. 5 is a view similar to FIG. 1, but viewed from another aspect.

Now referring to FIGS. 2-3 in conjunction with FIG. 5, a pair of first spring arms 32 are integrally formed on the front of the base wall 31. Each first spring arm 32 comprises a curved connecting portion 322 extending upwards and inwards from the base wall 31, and a vertical mating portion 321 extending upwards from the connecting portion 322 and having a free end. A space 32*a* is formed between the mating portions 321 of the pair of first spring arms 32 for receiving the pin terminal of the complement connector. The space 32*a* is arrayed in a line with the front opening 231 after the terminal 3 is held in the housing 2. A pair of projections 3211 extend toward each other from inside surfaces of the pair of vertical mating portions 321 adapted for mating with the pin terminal of the complement connector. Each terminal 3 has a pair of second spring arms 33 behind the first spring arms 32 adapted for holding a conductor (not shown) of a wire and a pair of third spring arms 34 behind the second spring arms 33 adapted for holding an insulator (not shown) at the outermost of a wire.

A pair of bar-shape blocking sections 26 are integrally formed on the top wall 25 of the housing 2. Each bar-shape blocking section 26 extends into the terminal passageway 23, and the front end of the bar-shape blocking section 26 physically connects with the inside surface of the front wall 21. Each bar-shape blocking section 26 has a length equal to that of the mating portion 321 of the terminal 3 along the mating direction. When the terminal 3 slides into the terminal passageway 23, the bar-shape blocking section 26 occupies upper section of the space 32*a* and abuts against the mating portions 321 of the terminal 3 to position the mating portions 321 and prevent improper mating with the pin terminal of the complement connector. The rear end of the bar-shape blocking section 26 is thinner than other portion of the bar-shape blocking section 26 to facilitate the insertion of the bar-shape blocking section 26 into the space 32*a* of the terminal 3.

Referring to FIGS. 1-4, a pair of retaining gaps 233 are formed through the front wall 21 and communicated with the pair of terminal passageways 23. A tip end 35 extends forwards from the front edge of the base wall 31 for being securely retained within the retaining gap 233.

A latch member 27 is integrally formed on the outer periphery of the top wall 25 of the housing 2 for retaining a locking state with the complement connector. The latch member 27 comprises a pair of feet 271 extending upwards from the top wall 25, a main body 272 including pressing portion 273 for releasing the complement connector and extending backwards from the feet 271, a claw 274 extending forwards from the main body 272 to locate between the pair of feet 271 for holding the complement connector.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electric connector for connecting a conductor of a conductive wire to a pin terminal of a complementary connector, comprising:

an insulative housing having front and rear walls, a terminal passageway defined between said front and rear walls, said terminal passageway having top and bottom walls; and a conductive terminal assembled to the insulative housing to be retained in the terminal passageway and having a base wall and a pair of spring arms extending from the base wall and adapted for mating with said pin terminal, said spring arms facing to each other and each having a free end and defining between said pair of spring arms a space adapted for receiving said pin terminal; wherein a bar-shape blocking section is integrally formed with said top wall of the terminal passageway and extends into said terminal passageway and is located between said free ends of the pair of spring arms to prevent unnecessary shake of the free ends of the spring arms.

2. The electric connector according to claim 1, wherein a pair of projections extend toward each other from inside surfaces of the pair of spring arms adapted for mating with the pin terminal of the complement connector.

3. The electric connector according to claim 1, wherein a retaining gap is formed through the front wall and communicated with the terminal passageway, and a tip end extends forwards from the front edge of the base wall of the terminal to be securely retained within the retaining gap.

4. The electric connector according to claim 1, wherein a latch member is integrally formed on the outer periphery of the housing for retaining a locking state with the complement connector.

5. The electric connector according to claim 1, wherein said latch member comprises a pair of feet extending upwards from the housing, a main body including pressing portion for releasing the complement connector and extending backwards from the feet, and a claw extending forwards from the main body to locate between the pair of feet for holding the complement connector.

6. The electric connector according to claim 1, wherein the terminal has a pair of second spring arms behind the first spring arms adapted for holding a conductor of said wire and a pair of third spring arms behind the second spring arms adapted for holding an insulator at the outermost of said wire.

7. The electric connector according to claim 1, wherein said bar-shape blocking section abuts against inner walls of said free ends.

8. The electric connector according to claim 7, wherein the rear end of the bar-shape blocking section is thinner than other portion thereof to facilitate the insertion of said bar-shape blocking section into said space of the terminal.

9. The electric connector according to claim 1, wherein a terminal retaining finger is integrally formed with the bottom wall and resiliently engage with the base wall of the terminal.

10. The electric connector according to claim 9, wherein a wedge-shape protrusion is formed at the free end of the terminal retaining finger, the base wall of the terminal forms a retaining hole for receiving said protrusion of the terminal retaining finger.

11. The electric connector according to claim 10, wherein said protrusion of the terminal forms an inclined surface to lead the terminal to pass through the protrusion of the terminal retaining finger.

12. An electrical connector comprising:

an insulative housing defining at least one passageway surrounded by walls and extending along a front-to-back direction;

a deflectable locking arm formed on one of said walls and defining a locking head extending into the passageway;

a contact including a base seated upon said one of the walls and defining a hole latchably receiving said locking head;

wherein said contact further includes a pair of contacting arms extending from two sides of the base away from said one of the walls;

wherein another one of said walls opposite to said one of the walls forms a protrusion in the passageway, and said pair of contacting arms sandwich said protrusion therebetween.

13. The electrical connector as claimed in claim 12, wherein said another one of the walls defines a trench in which the protrusion and two distal ends of said pair of contacting arms are located.

14. The electrical connector as claimed in claim 12, wherein said walls includes an end wall at an closed end of said passageway so as to have the contact inserted into the passageway from the other end, and said end wall defines a first opening in alignment with the protrusion and a second opening in alignment with the locking head both for molding consideration.

15. The electrical connector as claimed in claim 14, wherein said first opening is dimensioned and configured to receive a mating contact.

16. An electrical connector comprising:

an insulative housing defining at least one passageway surrounded by walls and extending along a front-to-back direction;

one of said wall defining a trench in an interior face region in which a protrusion is located; and a contact including a base abutting against another one of said walls opposite to said one of the walls, and a pair of deflectable contacting arms vertically extending from two sides of the base via corresponding root ends thereof; wherein a distal end of each of the pair of contacting arms is received in the trench and laterally moveably sandwiched between the protrusion and the interior face region of said one of the walls in a transverse; wherein each of said vertically extending contacting arms is equipped with an inward projection between the corresponding tip end and root end; wherein the distal end, the root end and the corresponding inward projection of each of said contacting arms are essentially vertically aligined with one another.

* * * * *